US006467379B1

(12) United States Patent
Wizman

(10) Patent No.: US 6,467,379 B1
(45) Date of Patent: Oct. 22, 2002

(54) SELF-ADJUSTING SOCKET

(76) Inventor: Simon Wizman, 2279 E. 22nd St., Brooklyn, NY (US) 11229

( * ) Notice: Subject to any disclaimer, the term of this patent is extended or adjusted under 35 U.S.C. 154(b) by 0 days.

(21) Appl. No.: 09/933,792

(22) Filed: Aug. 21, 2001

(51) Int. Cl.[7] ..... B25B 13/06
(52) U.S. Cl. ..... 81/185; 81/124.5
(58) Field of Search ..... 81/185, 124.4, 81/124.5, DIG. 11

(56) References Cited

U.S. PATENT DOCUMENTS 1,471,451 A 10/1923 Crimp
1,688,819 A 10/1928 Leck
1,896,949 A 2/1933 Greiner
1,997,948 A 4/1935 Pearson
2,711,112 A 6/1955 Durand
3,127,797 A 4/1964 Rogers
3,127,798 A 4/1964 Gol
3,298,261 A 1/1967 Lynn
3,698,267 A * 10/1972 Denney ..... 81/185
4,528,875 A 7/1985 Hurst et al.
5,157,995 A * 10/1992 Nogues ..... 81/124.5
5,163,344 A 11/1992 Mathers
5,829,328 A 11/1998 Chen

* cited by examiner

*Primary Examiner*—D. S. Meislin
(74) *Attorney, Agent, or Firm*—Michael I Kroll

(57) ABSTRACT

An adjustable socket for engaging various sized fastener projections such as hexagonal nuts, includes a socket body with a cavity having a spring-biased plate pushing nested and concentrically positioned sliding sleeves toward the socket opening and their first position. A retainer member restrains the outer sleeve and offset lower sleeve ends form interlocking shoulders to restrain the inner sleeves. Magnetic strip pairs are between the sleeves and integrated therewith to form magnetic couples when the sleeves are in the first position. The intrusion of a nut will encounter one or more of the smaller sleeves and shear the magnetic coupling between the largest of the smaller sleeves and the next largest sleeve. Magnetic couplings between the larger sleeves are maintained during the downward displacement of the smaller sleeves thus keeping such sleeves in the first position. The sleeve bore shapes can be chosen to engage all shapes of fastener projections.

46 Claims, 10 Drawing Sheets

SELF-ADJUSTING SOCKET

BACKGROUND OF THE INVENTION

1. Field of the Invention

The present invention relates generally to socket wrenches, and more specifically, to self-adjusting sockets that fit several sizes of fastener projections, e.g. hexagonal nuts and bolt heads.

2. Description of the Prior Art

There are other adjustable sockets. Typical of these is U.S. Pat. No. 1,471,451 issued to Alfred A. Crimp on Oct. 23, 1923.

Another patent was issued to George J. C. Lammers et al. on Feb. 22, 1927 as U.S. Pat. No. 1,618,715. Yet another U.S. Pat. No. 1,688,819 was issued to John Leck on Oct. 23, 1928 and still yet another was issued to John Greiner on Feb. 7, 1933 as U.S. Pat. No. 1,896,949.

Another patent was issued to Andrew Pearson on Apr. 16, 1935 as U.S. Pat. No. 1,997,948. Yet another U.S. Pat. No. 2,711,112 was issued to Adrein E. Durand on Jun. 21, 1955. Another was issued to Jesse P. Rogers on Apr. 7, 1964 as U.S. Pat. No. 3,127,797 and still yet another was issued on Apr. 7, 1964 to Michael J. Gol as U.S. Pat. No. 3,127,798. A patent was issued on Jan. 17, 1967 to Ben H. Lynn as U.S. Pat. No. 3,298,261 and on Jul. 16, 1985 U.S. Pat. No. 4,528,875 was issued to Andrew C. S. Hurst et al.

Another patent was issued to William S. Mathers on Nov. 17, 1992 as U.S. Pat. No. 5,163,344. Yet another U.S. Pat. No. 5,829,328 was issued to Shyong-Chwan Chen on Nov. 3, 1998.

U.S. Pat. No. 1,471,451

Inventor: Alfred A. Crimp

Issued: Oct. 23, 1923

A wrench comprising a stem, a socket casing, a series of sockets slidably nested in said casing, and means between said parts for permitting said sockets to move automatically to accommodate various sized nuts, said means comprising coil springs each having one end engageable with said stem and the other end secured to one of said sockets, and pins secured to alternate sockets and casing and slidable in slots in said sockets to limit the relative longitudinal movement and align the outer ends of said sockets.

U.S. Pat. No. 1,618,715

Inventor: George J. C. Lammers, et al.

Issued: Feb. 22, 1927

A multiple socket wrench comprising a series of nested hexagonal sockets, a slotted handle in the outer socket, a lever pivoted in said handle to be extended at an angle thereto, the outer socket being fixed and the inner sockets slidable therein, means for projecting a selected socket into position for use, pins in each socket extending outwardly beyond the outermost socket, and a spring lever having teeth to engage said pins selectively.

U.S. Pat. No. 1,688,819

Inventor: John Leck

Issued: Oct. 23, 1928

A centering tool comprising a body provided with a recess in one end and a drill seat axially aligned with the recess, a drill in the drill seat projecting into the recess, a bushing removably fitting the recess, the inner faces of opposite walls of the bushing parallel, the body and the bushing provided with aligned orifices, a pin projecting into the orifice in the body, a means to move the pin into and out of the orifice in the bushing, and a means to indicate a length of movement of the pin.

U.S. Pat. No. 1,896,949

Inventor: John Greiner

Issued: Feb. 7, 1933

In a socket wrench, the combination with an outer wrench body shell having a contracted nut engaging socket section of elongated formation and a tubular handle section of larger diameter than the first section and an intermediate tapered section integrally connecting the first two sections of a plurality of telescopically united nut engaging socket tubes telescopically mounted in the first section of the shell, a head for the handle section, said plurality of nut engaging socket tubes having extension arms, flanged rings of gradual increasing diameters located at one end of the handle section and having arms connected to the arms of the nut engaging socket tubes, said flange rings being abutted and the flanged ring of larger diameter engaging a shoulder where the tapered section merges into the handle section, thereby limiting the nut engaging socket tubes with their outer end edges flush, and spring means interposed between the flanged rings and the head, thereby yieldably mounting the nut engaging socket tubes.

U.S. Pat. No. 1,997,948

Inventor: Andrew Pearson

Issued: Apr. 16, 1935

A socket wrench including a hollow head open at one end and closed at its other, a set of socket members nested in encompassing relation, open at each end positioned within and movable automatically towards the closed end of said head selectively by and to accommodate various sized nuts, the inner members of said set having means at their inner ends completely spaced from the inner face of the head and bearing upon the inner ends of the outer members of the set to prevent said inner members dropping out of their nested positions from said head, said head and the outer member of said set having coacting means to prevent said outer member from dropping out of its nested position relative to said head, a controlling spring interposed between the inner member of said set and said closed end for normally maintaining said members in inner end abutting engagement, spring controlled means extending through opposed portions of said members and head for releasably latching the members together in nested position and to said head, the said coacting means on the outer member of said set being in the form of a pair of spaced leaf springs disposed lengthwise of and having their inner ends anchored to the outer face of said outer member, said springs having their outer portions curved towards and beyond the inner face of said head, the coacting means on said head being in the form of spaced tapered recesses in the outer portion of the inner face of said head, the outer walls of said recesses forming shoulders normally engaged by the outer end edges of the outer portions of said springs, and the said outer member of said set being of uniform thickness throughout and spaced throughout from the inner face of the head.

U.S. Pat. No. 2,711,112

Inventor: Adrien E. Durand

Issued: Jun. 21, 1955

A multiple socket wrench comprising a handle, a head member in the form of a socket on one end of said handle, a plurality of variously sized socket members nested in encompassing relation in the socket of the head member and longitudinally slidable one within another, and means for selectively and releasably latching said socket members in retracted nested position and arranged to release any one of them for longitudinal sliding movement relative to the others whereby it may be pushed outwardly into an extended position for service or pulled back into a retracted nested state, said means including a slotted selector disk revolvably mounted with respect to said head member and said socket members, and actuating fingers individually carried by said socket members protruding outwardly through the slots in said disk and arranged to be interengaged and releasably locked in said disk in certain of its rotated positions against longitudinal shifting movement therethrough but selectively releasable therefrom upon turning movement of the disk into different selected positions to effect manual shifting and exposure of a particular sized socket member for use or its retraction into a completely nested state within the others.

U.S. Pat. No. 3,127,797

Inventor: Jesse P. Rogers

Issued: Apr. 7, 1964

A self-selecting nut runner for quick advancement of a nut during continuous contact therewith comprising a housing connected in alignment with a removable outer socket casing, a plurality of normally aligned sockets encased by said outer socket, each of said plurality of sockets independently movable with respect to the adjacent sockets to accommodate various sized nuts, a first biasing means for maintaining said plurality of sockets in the normally aligned position, a shank normally connected at one end thereof to said housing, a floating handle means located at the other end on said shank, said handle means including a first section rigidly mounted on said shank, a second section slidably mounted on and extending beyond said first section, a second biasing means interengaging said first and second section normally biasing said second section in a disengaged position, means for engaging said second section to said shank comprising an axial polygonal shaped opening in said second section and a mating polygonal shaped member located on said shank, said second section being capable of being constrained to an inward engaged position engaging said shank.

U.S. Pat. No. 3,127,798

Inventor: Michael J. Gol

Issued: Apr. 7, 1964

An adjustable tool comprising: an outer tube; a plurality of nested tubes, each having at one end a portion within said outer tube, and each having a portion extending beyond the end of the tube of the next larger size; each of said tubes terminating at the other end in a respective plunger and the plungers being aligned longitudinally with juxtaposed radial surfaces; a sleeve enclosing the peripheral surfaces of said plungers; detent means including a set of annular recesses and resilient locking means disposed between said sleeve and each of said plungers; each of said inner tubes being movable inwardly to a telescoped condition within the tube of next larger size in response to the application of inward force upon the respective extending portion whereby the associated plungers are adapted to assume a new axial position in said sleeve, being secured in new position by said detent means, and reset means disposed for applying an outward motion upon said plungers for returning inwardly telescoped tubes to the position at which the said portions extend beyond the end of the tube of next larger size.

U.S. Pat. No. 3,298,261

Inventor: Ben H. Lynn

Issued: Jan. 17, 1967

A multi-socket wrench of the character described a primary outer socket of polygonal tubing of substantially uniform cross section and wall thickness with one end potion thereof adapted to engage over a first size said polygonal shaped bolt head or nut for rotating same, a drive means secured in the opposite end portion of said primary socket for connecting same to a driving means for rotating said socket about the axis thereof, an inner socket of said polygonal shape and substantially uniform wall thickness slidably retained within said primary socket in close proximity therewith with the outer end portion thereof adapted to engage over a second size polygonal bolt head or nut for rotating same, a pin secured in the opposite end of said inner socket in transverse central relation thereto, a retainer means integral with said drive means and extending within said outer socket for engaging said pin for holding the said outer end portion of said inner socket substantially coplanar with said end portion of said outer socket and permitting predetermined inward movement of said inner socket, and compression spring means biased between the inner side of said drive means and the inner end of said inner socket for normally urging the latter into said normal position.

U.S. Pat. No. 4,528,875

Inventor: Andrew C. S. Hurst et al.

Issued: Jul. 16, 1985

A socket having an interior working part shaped to engage an item such as a nut and having an insert which is geometrically similar to said interior working part of the socket, said insert being a sliding close fit within the socket so as to be movable to and from a position of use and so that one of the socket and said insert can be used to engage said item, and including means to urge said insert towards the position of use, and means for selectively restraining said insert in the position of use.

U.S. Pat. No. 5,163,344

Inventor: William S. Mathers

Issued: Nov. 17, 1992

An adjustable socket includes a plurality of sleeves concentrically aligned relative to one another and arranged in a biased orientation towards the lower terminal end of an associated socket, including interlocking projections to maintain the sleeves in a nested concentric relationship adjacent the lower terminal end of the socket, wherein the sleeves are selectively displaced, with each sleeve including a separate spring member to maintain each respective sleeve in the coaxial relationship.

U.S. Pat. No. 5,829,328

Inventor: Shyong-Chwan Chen

Issued: Nov. 3, 1998

A multiple sockets wrench which is able to accommodate and twist a great variety of differently sized and shaped nuts, bolts and screws. The wrench includes a polygonal tubular housing and several groups of clamping blocks axially retractably received in a front end of the housing. When used to twist a nut or a bolt head, the nut or bolt head contacts with the groups of the clamping blocks to force the unsuitable contacted clamping blocks into the housing, while permitting the suitable uncontacted clamping blocks to hold the nut or bolt head.

While these socket devices may be suitable for the purposes for which they were designed, they would not be as suitable for the purposes of the present invention, as hereinafter described. In particular, no prior art adjustable sockets use magnetic couples between sliding sleeves to retain the larger sleeves in place as the smaller sleeves are displaced by the intruding nut or bolt head to be wrenched.

SUMMARY OF THE PRESENT INVENTION

A primary object of the present invention is to provide a self-adjusting socket to accommodate different sized nuts and bolt heads without the user having to make any changes or adjustments.

An additional object of the present invention is to provide a self-adjusting socket having a plurality of concentric hexagonal sleeves.

A further object of the present invention is to provide a self-adjusting socket wherein the plurality of concentric hexagonal sleeve are biased towards the open end of the socket by a movable plate and a spring member, the hexagonal sleeves being retained within the socket by a flanged threaded retainer member extending peripherally across a portion of the open end of said socket.

A yet further object of the present invention is to provide a self-adjusting socket wherein the concentric hexagonal sleeves travel independently in response to pressure applied thereto by the insertion of a nut or bolt head.

Another object of the present invention is to provide a self-adjusting socket wherein each hexagonal sleeve employs magnetic strips to magnetically pair with adjacent sleeves, so as to maintain the larger sleeves in their original position while one or more smaller sleeves are being displaced by an intruding fastener projection.

One more object of the present invention is to provide a self-adjusting socket that is simple and easy to use.

A further object of the present invention is to provide a self-adjusting socket that is economical in cost to manufacture.

Further objects of the present invention will appear as the description proceeds.

The present invention is an adjustable socket for attachment to a typical tool handle, that has a plurality of concentric sleeves nested within a socket body cavity, wherein the pressure of a fastener such as a nut or bolt head being applied to one or more of the sleeves will thrust such sleeves longitudinally into said socket body while the larger sleeves, not directly borne upon by the insertion of the nut or bolt head, will remain stationary due to magnetic strip pairs that are positioned between the sleeves and integrated therewith. The magnetic strips are aligned on the sleeves to magnetically couple when the sleeves are in the upper first position. A singular spring member and a movable plate biases the sleeves toward the socket upper body end until a greater opposing bias is introduced by the insertion of the nut or bolt head. A retainer member prevents the plate from moving the sleeves out of the socket body cavity.

An adjustable socket is provided for attachment to the driving projection of a tool and for receiving and turning variously sized fastener projections, comprising: a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end; a plate positioned in the main body cavity, the plate being generally perpendicular to the main body central axis; a spring positioned within the main body cavity to bear upon the main body and the plate, such that the plate is biased toward the upper terminal end; a peripheral sleeve concentrically mounted within the main body cavity, the peripheral sleeve having an inner surface defining a bore, an upper end and a lower end, the lower end having a downwardly facing shoulder about the bore, the bore being shaped for receiving and engaging one of the fastener projections; a retainer member attached to the upper terminal end, the retainer member having a portion protruding across the main body cavity to an extent that the peripheral sleeve is prevented from exiting the main body cavity; a first sliding sleeve, having a lower end, the first sliding sleeve being concentrically mounted within the peripheral sleeve in a first position, wherein the first sliding sleeve and peripheral sleeve lower ends are adjacent the plate, and wherein the first sliding sleeve is slidably displaceable in a downward direction relative to the peripheral sleeve, in a coaxially aligned relationship, to a second position, wherein the first sliding sleeve lower end displaces the plate from the peripheral sleeve lower end; a plurality of sliding sleeves, in addition to the first sliding sleeve, each having a lower end, each sliding sleeve in the plurality being of descending width, such that the sleeves are concentrically mounted within the first sliding sleeve in a first position, wherein the lower ends of the peripheral sleeve and all the sliding sleeves are adjacent the plate, and wherein each of the plurality is slidably displaceable in a downward direction relative to the next largest sliding sleeve, the displacement being in a coaxially aligned relationship with such next largest sliding sleeve, to a second position, wherein the displaced sliding sleeve lower end displaces the plate from the peripheral sleeve lower end and the lower ends of all the sliding sleeves larger than the one so displaced; each of the sliding sleeves having an inner surface defining a bore, the bore being shaped to engage one of the fastener projections, each of the sliding sleeves' lower ends also being offset to form an exterior upwardly facing shoulder and an interior downwardly facing shoulder, each exterior shoulder corresponding with the interior shoulder of the next largest of the sliding sleeves, the exterior shoulder of the first sliding sleeve corresponding with the downwardly facing shoulder of the peripheral sleeve, the shoulder correspondences preventing upward displacement of the sliding sleeves from the first position; and a plurality of magnetic strip pairs, each pair being magnetically coupled, the first of such pairs having a first strip integrated with the upper body interior surface and a second strip integrated with the peripheral sleeve, the second of such pairs having a first strip integrated with the peripheral sleeve and a second strip integrated with the first sliding sleeve, the remainder of the pairs in the plurality having a first strip integrated with one of the sliding sleeves, and a second strip integrated with the next smallest sliding sleeve, all of the pairs in the plurality being attached such that the first strip and second strip of each pair are adjacent to one another when the sliding sleeves are in the first position; such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the magnetic strip pairs of the larger sliding sleeves retaining the larger sliding sleeves in the first position, and further such that, when the fastener projection is removed from the main body cavity, the spring urges the plate against the lower ends of the downwardly displaced sliding sleeves, forcing such sliding sleeves back to the first position.

In another embodiment, the strips in the magnetic strip pairs each have a magnetic coupling force, the coupling forces decreasing from the outermost pair to the innermost pair.

In another embodiment, the strips in the magnetic strip pairs each have a length, the lengths decreasing from the outermost pair to the innermost pair.

In another embodiment, the strips in the magnetic strip pairs each have an exterior area, the exterior areas decreasing from the outermost pair to the innermost pair.

In another embodiment, the strips in the magnetic strip pairs each have a volumes, the volumes decreasing from the outermost pair to the innermost pair.

In another embodiment, the retainer member is threadably attached to the upper body.

In another embodiment, the retainer member is rotatably attached to the upper body.

In another embodiment, the sliding sleeves each have an upper end, the upper ends being substantially flush to the upper body terminal end when the sliding sleeves are in the first position.

In another embodiment, the sliding sleeves' bores are hexagon shaped.

In another embodiment, the sliding sleeves' bores are polygon shaped.

In another embodiment, the sliding sleeves' bores are circumferentially notched for engaging the points of a polygon shaped fastener projection.

In another embodiment, the sliding sleeves' bores are square.

In another embodiment, the driving projection is square.

In one embodiment, an adjustable socket is provided for attachment to the driving projection of a tool and for receiving and turning variously sized fastener projections, comprising: a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end; a plate positioned in the main body cavity, the plate being generally perpendicular to the main body central axis; a spring positioned within the main body cavity to bear upon the main body and the plate, such that the plate is biased toward the upper terminal end; a peripheral sleeve concentrically mounted within the main body cavity, the peripheral sleeve having an inner surface defining a bore, an upper end and a lower end, the lower end having a downwardly facing shoulder about the bore, the bore being shaped for receiving and engaging one of the fastener projections; means for retaining the peripheral sleeve within the main body cavity; a first sliding sleeve, having a lower end, the first sliding sleeve being concentrically mounted within the peripheral sleeve in a first position, wherein the first sliding sleeve and peripheral sleeve lower ends are adjacent the plate, and wherein the first sliding sleeve is slidably displaceable in a downward direction relative to the peripheral sleeve, in a coaxially aligned relationship, to a second position, wherein the first sliding sleeve lower end displaces the plate from the peripheral sleeve lower end; a plurality of sliding sleeves, in addition to the first sliding sleeve, each having a lower end, each sliding sleeve in the plurality being of descending width, such that the sleeves are concentrically mounted within the first sliding sleeve in a first position, wherein the lower ends of the peripheral sleeve and all the sliding sleeves are adjacent the plate, and wherein each of the plurality is slidably displaceable in a downward direction relative to the next largest sliding sleeve, the displacement being in a coaxially aligned relationship with such next largest sliding sleeve, to a second position, wherein the displaced sliding sleeve lower end displaces the plate from the peripheral sleeve lower end and the lower ends of all the sliding sleeves larger than the one so displaced; each of the sliding sleeves having an inner surface defining a bore, the bore being shaped to engage one of the fastener projections; means for retaining the sliding sleeves within the main body cavity; and means for magnetically retaining each of the sliding sleeves in the first position when the plate is moved away from each of said sliding sleeve's lower ends; such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the means for retaining at least one sliding sleeve in the first position retaining the larger sliding sleeves in the first position, and further such that, when the fastener projection is removed from the main body cavity, the spring urges the plate against the lower ends of the downwardly displaced sliding sleeves, forcing such sliding sleeves back to the first position.

In one embodiment, an adjustable socket is provided for attachment to the driving projection of a tool and for receiving and turning variously sized fastener projections, comprising: a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end; a plate positioned in the main body cavity, the plate being generally perpendicular to the main body central axis; a spring positioned within the main body cavity to bear upon the main body and the plate, such that the plate is biased toward the upper terminal end; a peripheral sleeve concentrically mounted within the main body cavity, the peripheral sleeve having an inner surface defining a bore, an upper end and a lower end, the bore being shaped for receiving and engaging one of the fastener projections; a retainer member attached to the upper terminal end, the retainer member having a portion protruding across the main body cavity to an extent that the peripheral sleeve is prevented from exiting the main body cavity; a first sliding sleeve, having a lower end, the first sliding sleeve being concentrically mounted within the peripheral sleeve in a first position, wherein the first sliding sleeve and peripheral sleeve lower ends are adjacent the plate, and wherein the first sliding sleeve is slidably displaceable in a downward direction relative to the peripheral sleeve, in a coaxially aligned relationship, to a second position, wherein the first sliding sleeve lower end displaces the plate from the peripheral sleeve lower end; a plurality of sliding sleeves, in addition to the first sliding sleeve, each having a lower end, each sliding sleeve in the plurality being of descending width, such that the sleeves are concentrically mounted within the first sliding sleeve in a first position, wherein the lower ends of the peripheral sleeve and all the sliding sleeves are adjacent the plate, and wherein each of the plurality is slidably displaceable in a downward direction relative to the next largest sliding sleeve, the displacement being in a coaxially aligned relationship with such next largest sliding sleeve, to a second position, wherein the displaced sliding sleeve lower end displaces the plate from the peripheral sleeve lower end and the lower ends of all the sliding sleeves larger than the one so displaced; each of the sliding sleeves having an inner surface defining a bore, the bore being shaped to engage one of the fastener projections, each of the sliding sleeves' lower ends also being radially and outwardly disposed with respect to the central axis, the peripheral sleeve lower end having a reduced thickness to accommodate the first sliding sleeve lower end, the lower end outward dispositions causing the peripheral sleeve to prevent upward displacement of the first sliding sleeve from the first position, and causing the sliding sleeves to prevent the upward displacement of the next smallest sliding sleeve from the first position; and a plurality of magnetic strip pairs, each pair being magnetically coupled, the first of such pairs having a first strip integrated with the upper body interior surface and a second strip integrated with the peripheral sleeve, the second of such pairs having a first strip integrated with the peripheral sleeve and a second strip integrated with the first sliding sleeve, the remainder of the pairs in the plurality having a first strip integrated with one of the sliding sleeves, and a second strip integrated with the next smallest sliding sleeve, all of the pairs in the plurality being attached such that the first strip and second strip of each pair are adjacent to one another when the sliding sleeves are in the first position; such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the magnetic strip pairs of the larger sliding sleeves retaining the larger sliding sleeves in the first position, and further such that, when the fastener projection is removed from the main body cavity, the spring urges the plate against the lower ends of the downwardly displaced sliding sleeves, forcing such sliding sleeves back to the first position.

In one embodiment, an adjustable socket is provided for attachment to the driving projection of a tool and for receiving and turning variously sized fastener projections, comprising: a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end; a plate positioned in the main body cavity, the plate being generally perpendicular to the main body central axis; a spring positioned within the main body cavity to bear upon the main body and the plate, such that the plate is biased toward the upper terminal end; a peripheral sleeve concentrically mounted within the main body cavity and attached to the upper body, the peripheral sleeve having an inner surface defining a bore, and a lower end, the bore being shaped for receiving and engaging one of the fastener projections; a first sliding sleeve concentrically mounted within the peripheral sleeve in a first position, the first sliding sleeve having an angled lower flange extending under the peripheral sleeve lower end such that the peripheral sleeve lower end is adjacent the first sliding sleeve lower flange, and wherein the first sliding sleeve is slidably displaceable in a downward direction relative to the peripheral sleeve, in a coaxially aligned relationship, to a second position; a plurality of sliding sleeves, in addition to the first sliding sleeve, each such sliding sleeve being of descending width such that the plurality is concentrically mounted within the first sliding sleeve in a first position, with each of the sliding sleeves having an angled lower flange, extending under the lower flange of the next largest sliding sleeve, such that the lower flange of the innermost sliding sleeve is adjacent the plate, and, further, wherein each of the plurality is slidably displaceable in a downward direction relative to the next largest sliding sleeve, the displacement being in a coaxially aligned relationship with such next largest sliding sleeve, to a second position, such that the lower flange of the innermost sliding sleeve displaces the plate when any of the sliding sleeves are displaced to the second position; each of the sliding sleeves having an inner surface defining a bore, the bore being shaped to engage one of the fastener projections; and a plurality of magnetic strip pairs, each pair being magnetically coupled, the first of such pairs having a first strip integrated with the peripheral sleeve and a second strip integrated with the first sliding sleeve, the remainder of the pairs in the plurality having a first strip integrated with one of the sliding sleeves, and a second strip integrated with the next smallest sliding sleeve, all of the pairs in the plurality being attached such that the first strip and second strip of each pair are adjacent to one another when the sliding sleeves are in the first position; such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the magnetic strip pairs of the larger sliding sleeves retaining the larger sliding sleeves in the first position, and further such that, when the fastener projection is removed from the main body cavity, the spring urges the plate against the lower flange of the innermost sliding sleeve, forcing the displaced sliding sleeves back to the first position.

To the accomplishment of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views in which:

FIG. 1 is a perspective view of the present invention in use. The adjustable socket includes a plurality of sleeves concentrically aligned relative to one another and arranged in a biased orientation towards the upper terminal end of an associated socket body, including interlocking projections to maintain the sleeves in a nested concentric relationship adjacent the upper terminal end of the socket body, from which position the sleeves are selectively displaced by the intrusion of a fastener projection, such as a hexagonal nut or bolt head.

DESCRIPTION OF THE REFERENCED NUMERALS

Figure 1:
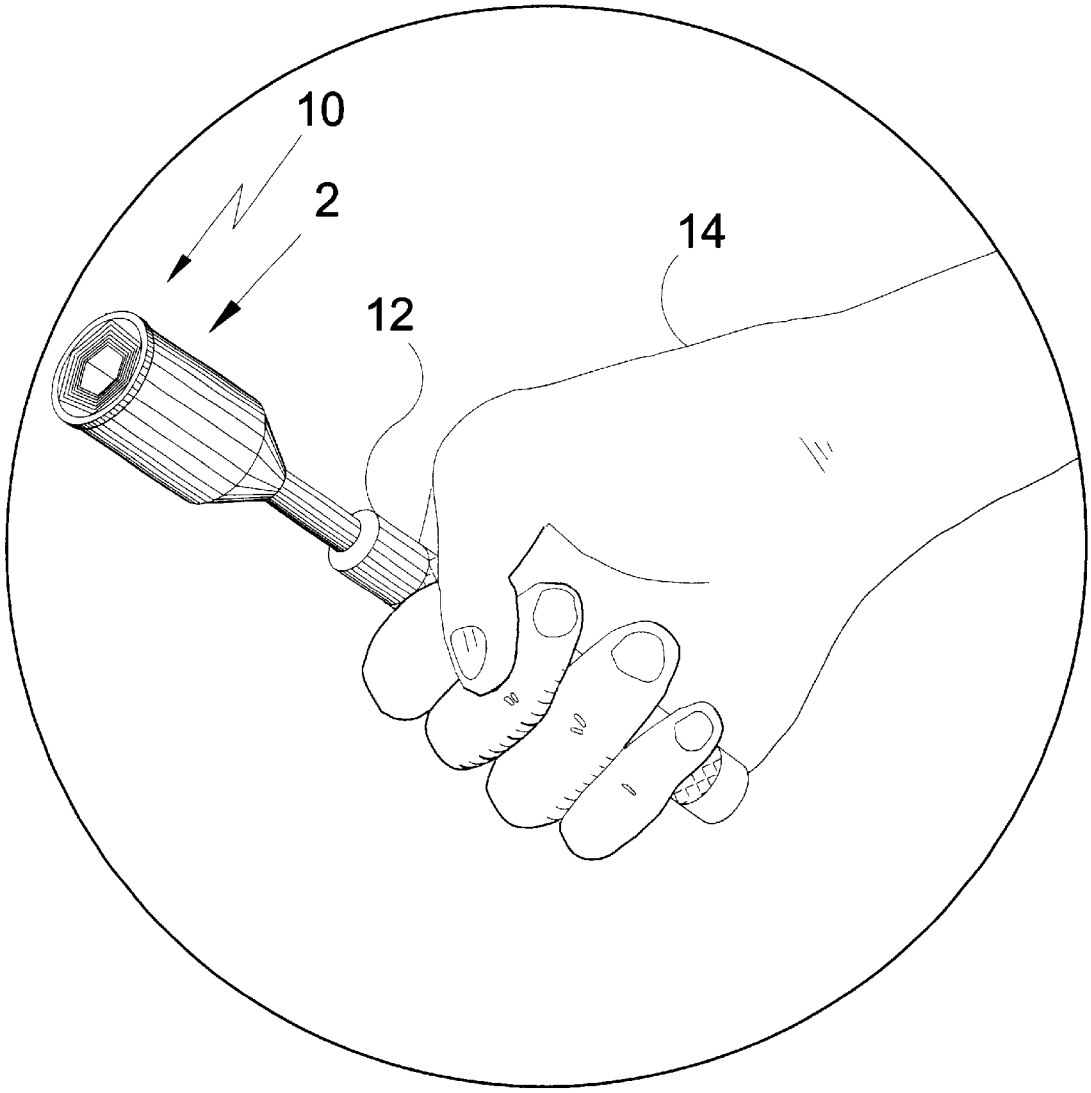

Turning now descriptively to the drawings, in which similar reference characters denote similar elements throughout the several views, the figures illustrate the Self-Adjusting Socket of the present invention. With regard to the reference numerals used, the following numbering is used throughout the various drawing figures.

10 Self-Adjusting Socket of the present invention
12 tool handle
14 user's hand
16 hexagonal nut
20 main body
22 lower body
24 lower body end
26 lower body bore
30 upper body
32 upper end
34 retainer member
36 main body cavity
38 spring
40 plate
42 peripheral plate
44 peripheral plate exterior surface
46 peripheral plate lower end
48 peripheral plate upper end
50 peripheral plate downwardly facing shoulder
52 peripheral plate interior surface
60 first sleeve
62 first sleeve lower end
64 first sleeve upper end
66 first sleeve interior downwardly facing shoulder
68 first sleeve exterior upwardly facing shoulder
70 second sleeve
72 second sleeve lower end
74 second sleeve upper end
76 second sleeve interior downwardly facing shoulder
78 second sleeve exterior upwardly facing shoulder
80 third sleeve
82 third sleeve lower end
84 third sleeve upper end
86 third sleeve interior downwardly facing shoulder
88 third sleeve exterior upwardly facing shoulder
90 fourth sleeve
92 fourth sleeve lower end
94 fourth sleeve upper end
96 fourth sleeve interior downwardly facing shoulder
98 fourth sleeve exterior upwardly facing shoulder
100 fifth sleeve
102 fifth sleeve lower end
104 fifth sleeve upper end
106 fifth sleeve interior downwardly facing shoulder
108 fifth sleeve exterior upwardly facing shoulder
110 magnetic strip pair
112 magnetic strip pair
114 magnetic strip pair
116 magnetic strip pair
118 magnetic strip pair
120 magnetic strip pair
122 upper body interior wall
200 alternate embodiment

202 peripheral sleeve lower end
204 first sleeve lower end
206 second sleeve lower end
208 third sleeve lower end
210 fourth sleeve lower end
212 fifth sleeve lower end
300 alternate embodiment
302 combined peripheral sleeve and retainer member
304 first sleeve
306 second sleeve
308 third sleeve
310 fourth sleeve
312 fifth sleeve
314 sixth sleeve
316 first sleeve lower end
318 second sleeve lower end
320 third sleeve lower end
322 fourth sleeve lower end
324 fifth sleeve lower end
326 sixth sleeve lower end
328 peripheral sleeve lower end
330 magnetic strip pairs

DETAILED DESCRIPTION OF THE PREFERRED EMBODIMENTS

The following discussion describes in detail various embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

FIGS. 1–10 depict various views and components of the socket 10 of the present invention. FIG. 1 depicts the socket 10 attached to a tool handle 12 held in the user's hand 14.

Figure 2:
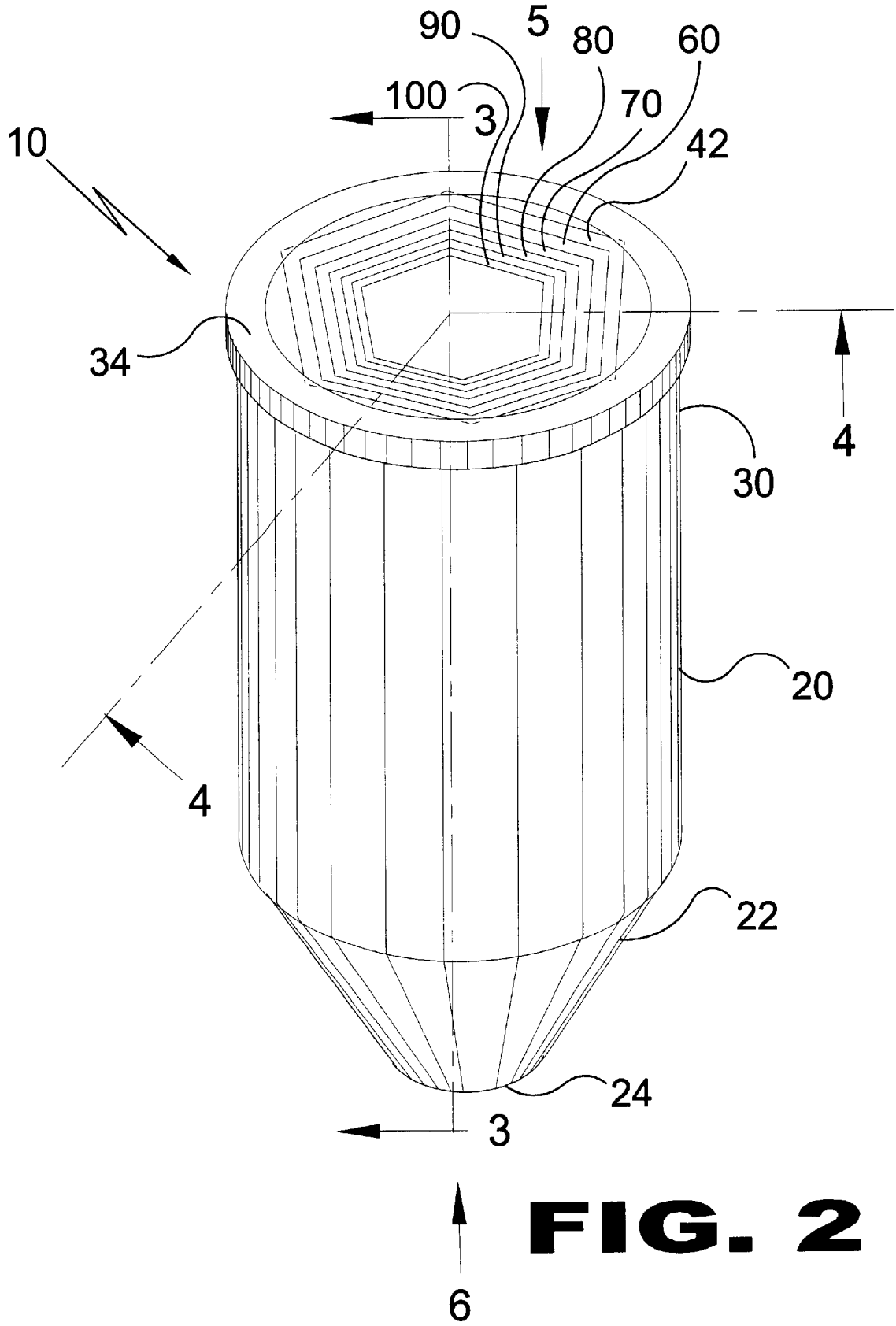
FIG. 2 is a perspective view of the present invention. The adjustable socket is a used for the grasping and turning of fastener projections, including hexagonal bolts and nuts of different sizes, without having to change a socket of one size for that of another.
Figure 3:
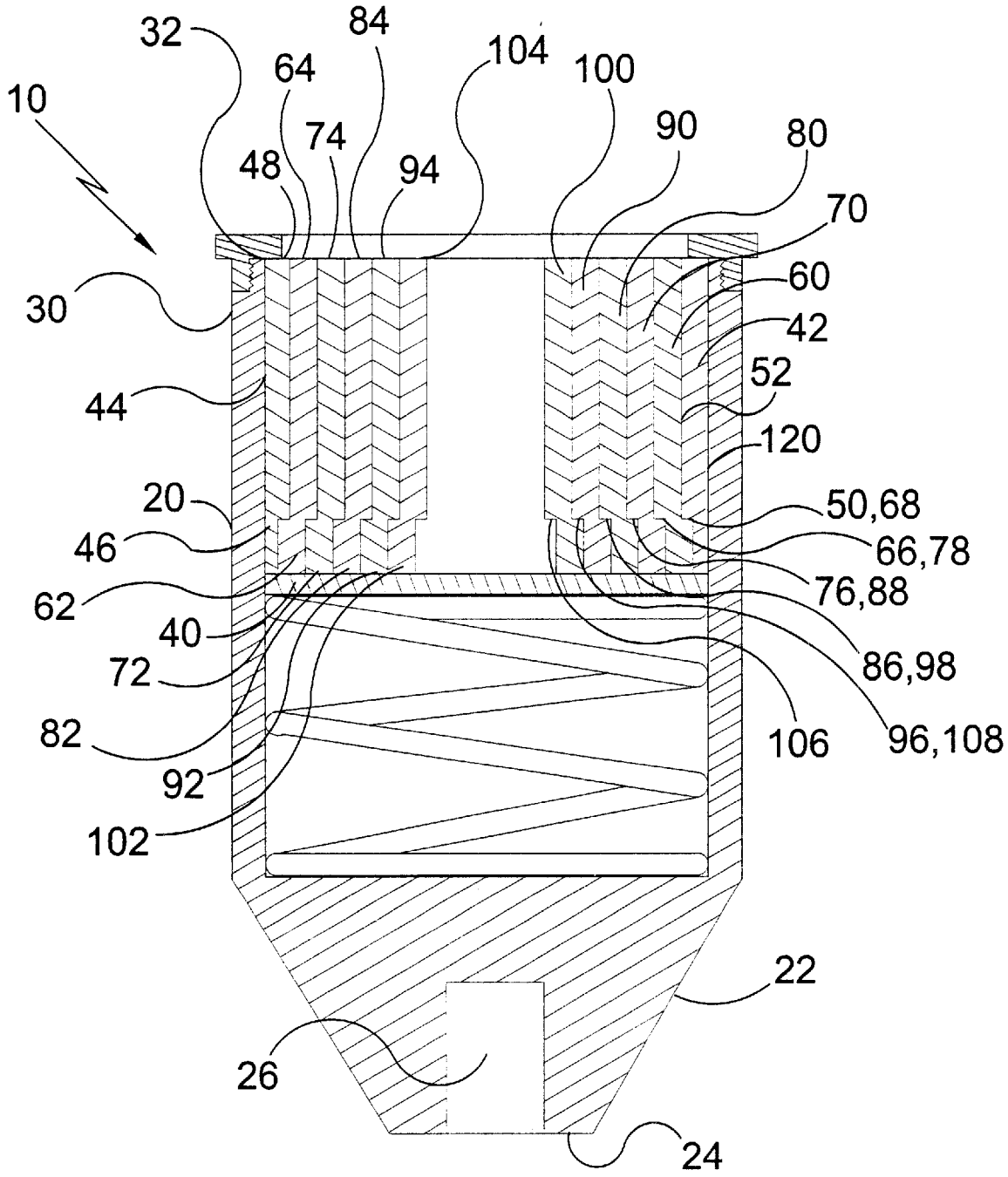
FIG. 3 is a side view of the present invention. The socket of the present invention consists of a body with a threaded, ring-shaped retainer member that holds captive the hexagonally-bored sleeves.
Figure 4:
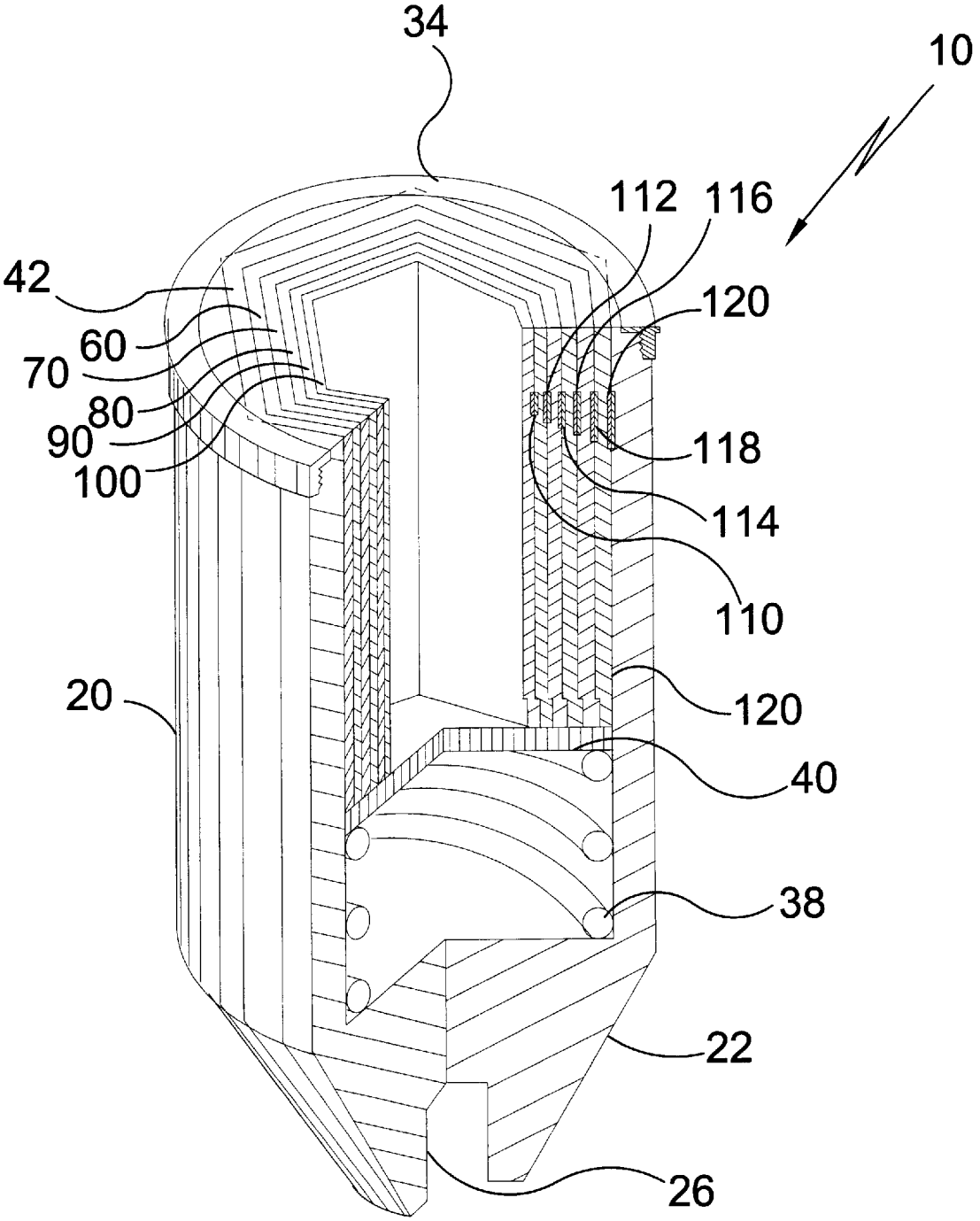
FIG. 4 is a perspective sectional view of the present invention. The sleeves contain magnetic strips that couple in the spaces between the sleeves to prevent the larger sleeves from moving with the smaller sleeves when the insertion of a nut or bolt displaces the smaller sleeves, and the compression of the spring allows the plate to depart from the lower ends of the larger sleeves.
Figure 7:
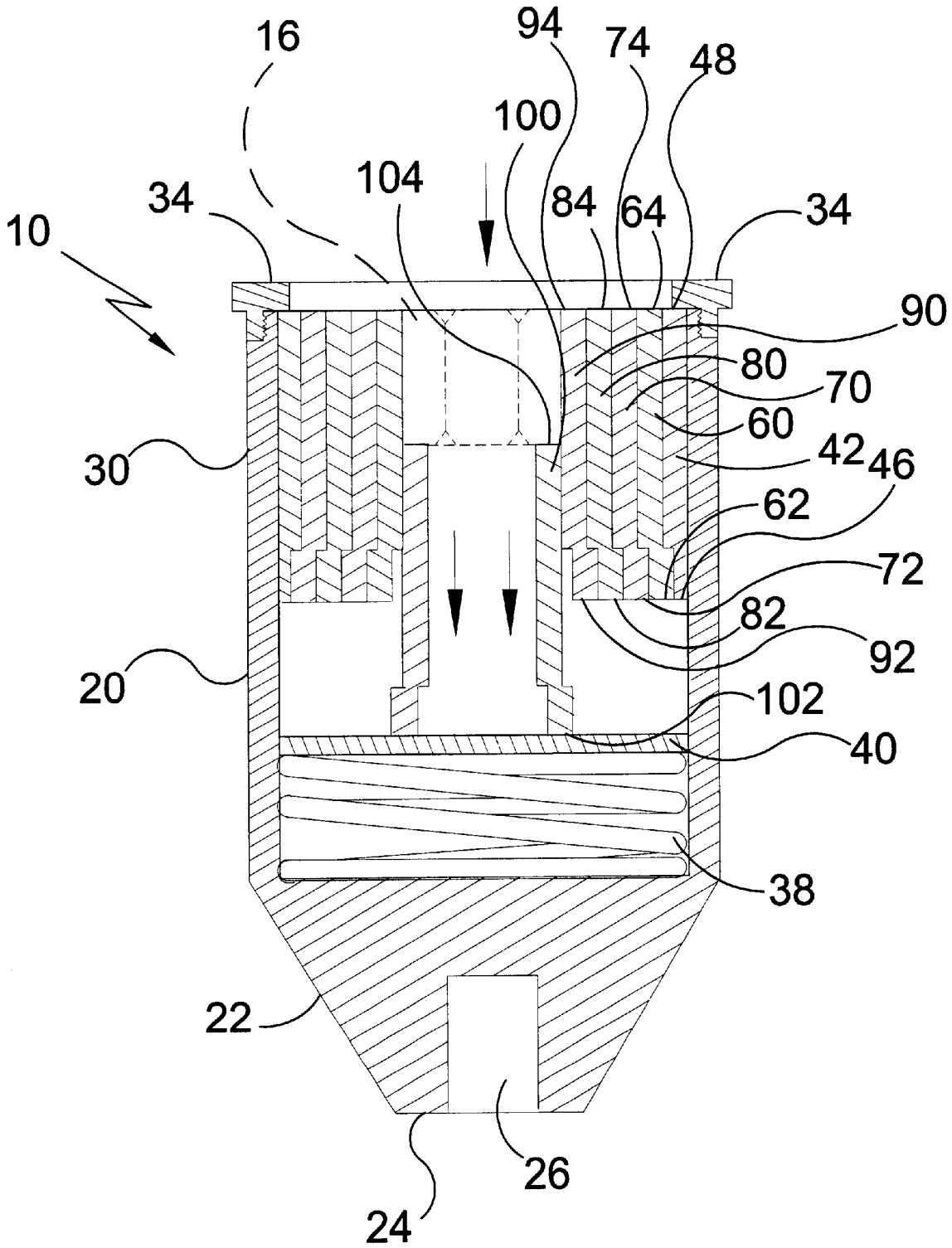
FIG. 7 is a sectional side view of the present invention depicting the relationships between the sleeves as a nut displaces the innermost sleeve.
Figure 8:
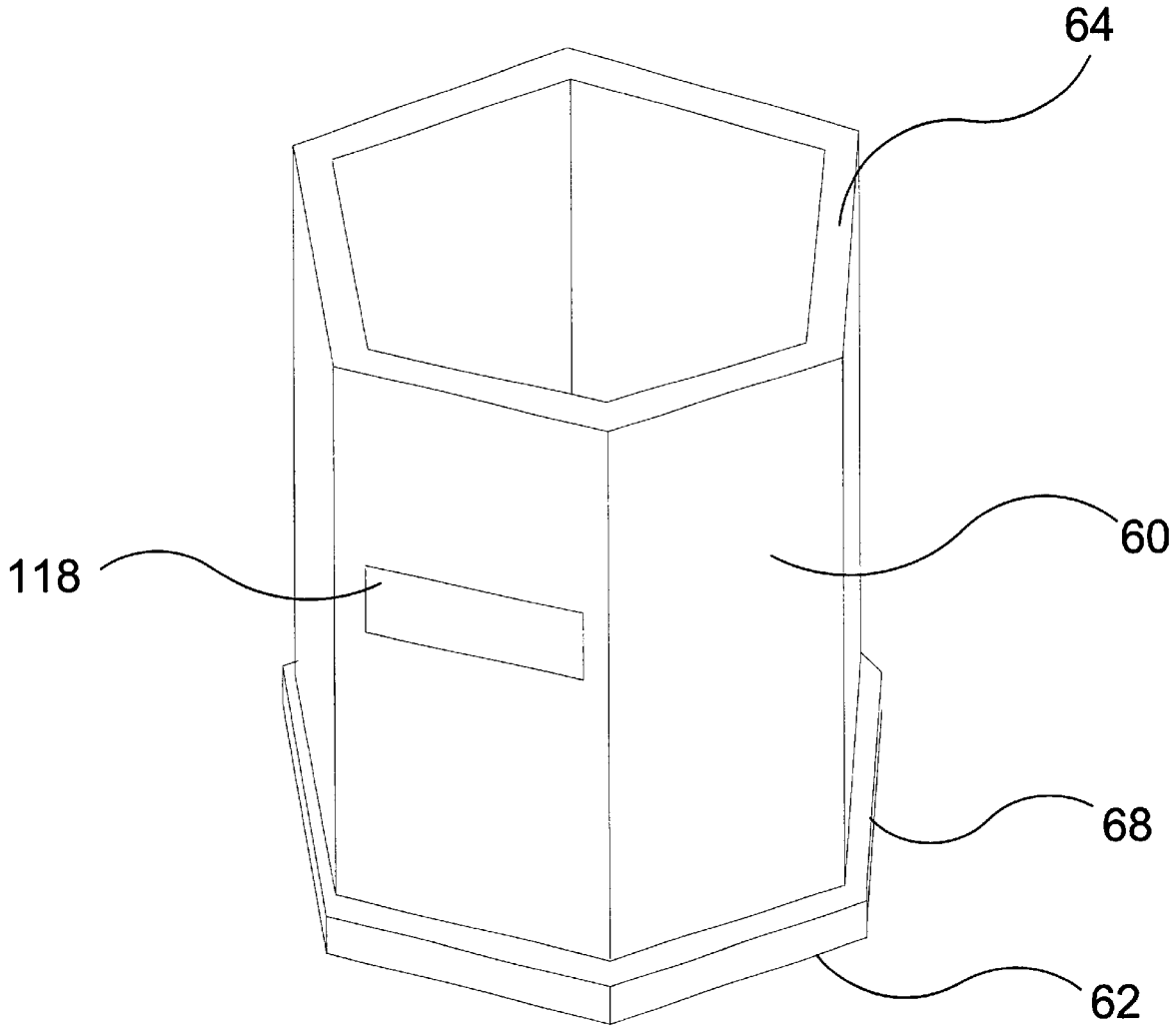
FIG. 8 is a perspective view of a hexagonal sleeve. The position of the magnetic strip is shown along with the offset lower end that interlocks with similar offset ends on the other sleeves.
Figure 9:
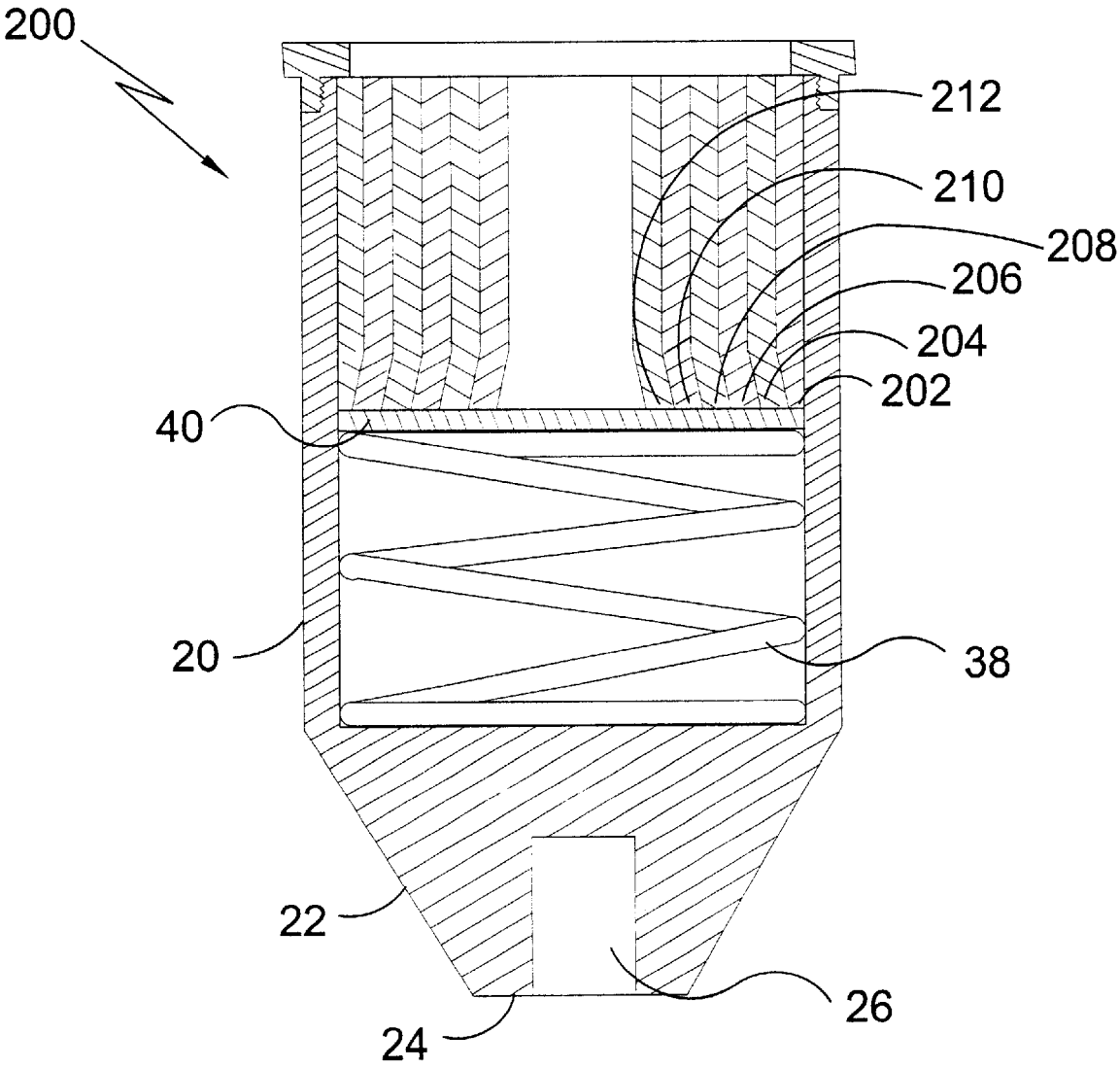
FIG. 9 is sectional side view showing an alternate embodiment with a second means of interlocking the sleeves as necessary to prevent upward movement of the sleeves from the position shown.
Figure 10:
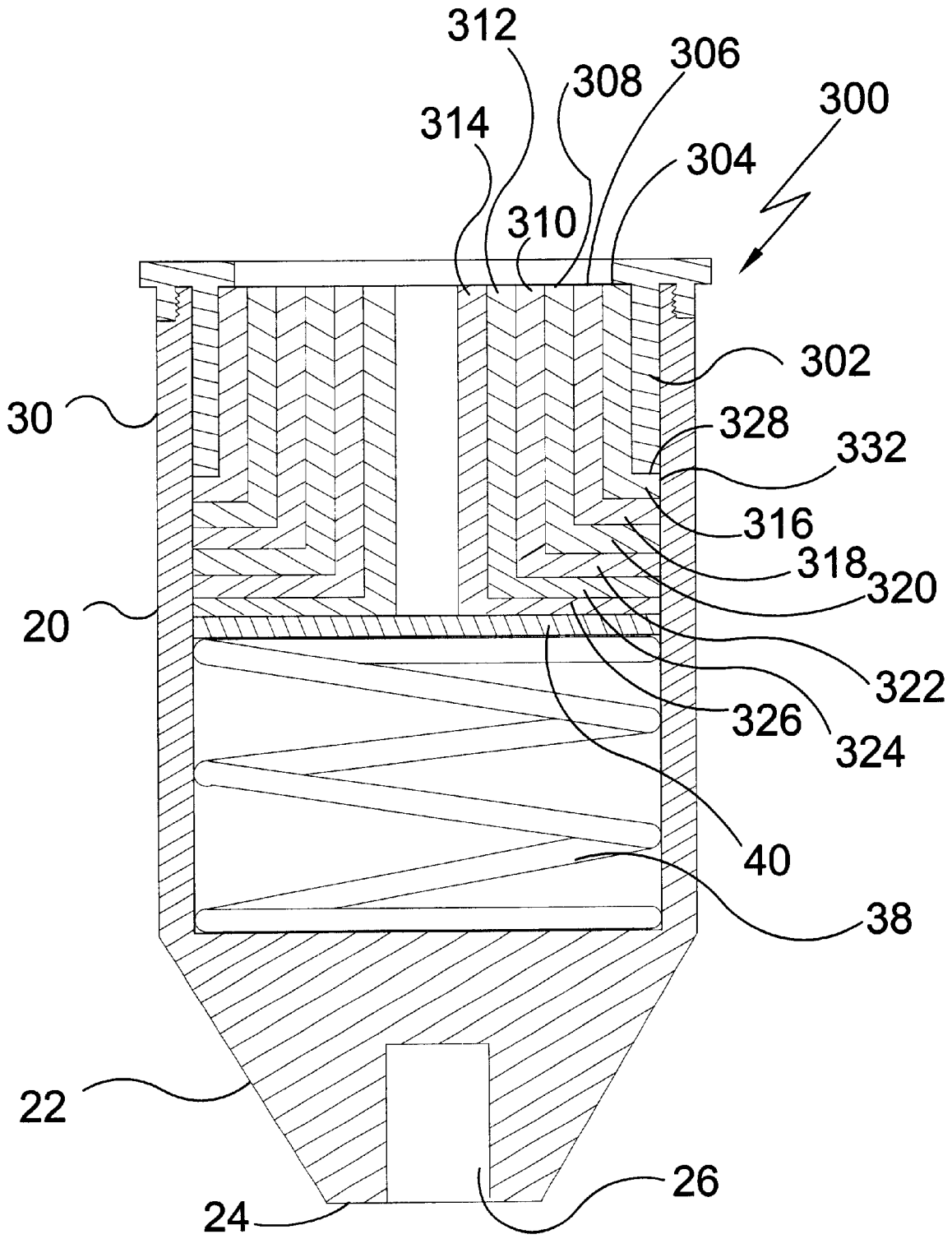
FIG. 10 is a side view showing an alternate embodiment with a third means of interlocking the sleeves as necessary to prevent upward movement of the sleeves from the position shown.

As shown in FIGS. 2–4, the socket 10 has a metal main body 20, formed about a central axis, the main body 20 having a lower body 22 with a lower end 24, into which is directed a bore 26 for receiving the driving projection of a tool handle 12. Typically the driving projection is square, and the bore 26 shown in FIG. 3, FIG. 9 and FIG. 10 is shaped to receive such a projection. As shown in FIG. 7, the socket 10 receives and engages various fastener projections 16 such as the hexagonal head nut shown. The invention contemplates adaptation for all fastener projections, including bolt heads, screw heads, nuts, and the like, whether hexagonal, square, or of other polygonal shapes.

An upper body 30 portion of the main body 20 has a threaded upper end 32 for threaded coupling with a ring-shaped retainer member 34.

Projecting within the main body 20 is a main body cavity 36. In the preferred embodiments, the main body cavity 36 is hexagonal. In other embodiments, it is anticipated that other shapes will be utilized in order to accommodate a variety of fastener projections 16, as discussed above. In the lower main body cavity 36 is a spring 38 that is positioned between and against the main body 20 and a hexagon shaped plate 40, the plate being positioned perpendicular to the center axis of the main body 20.

Figure 5:
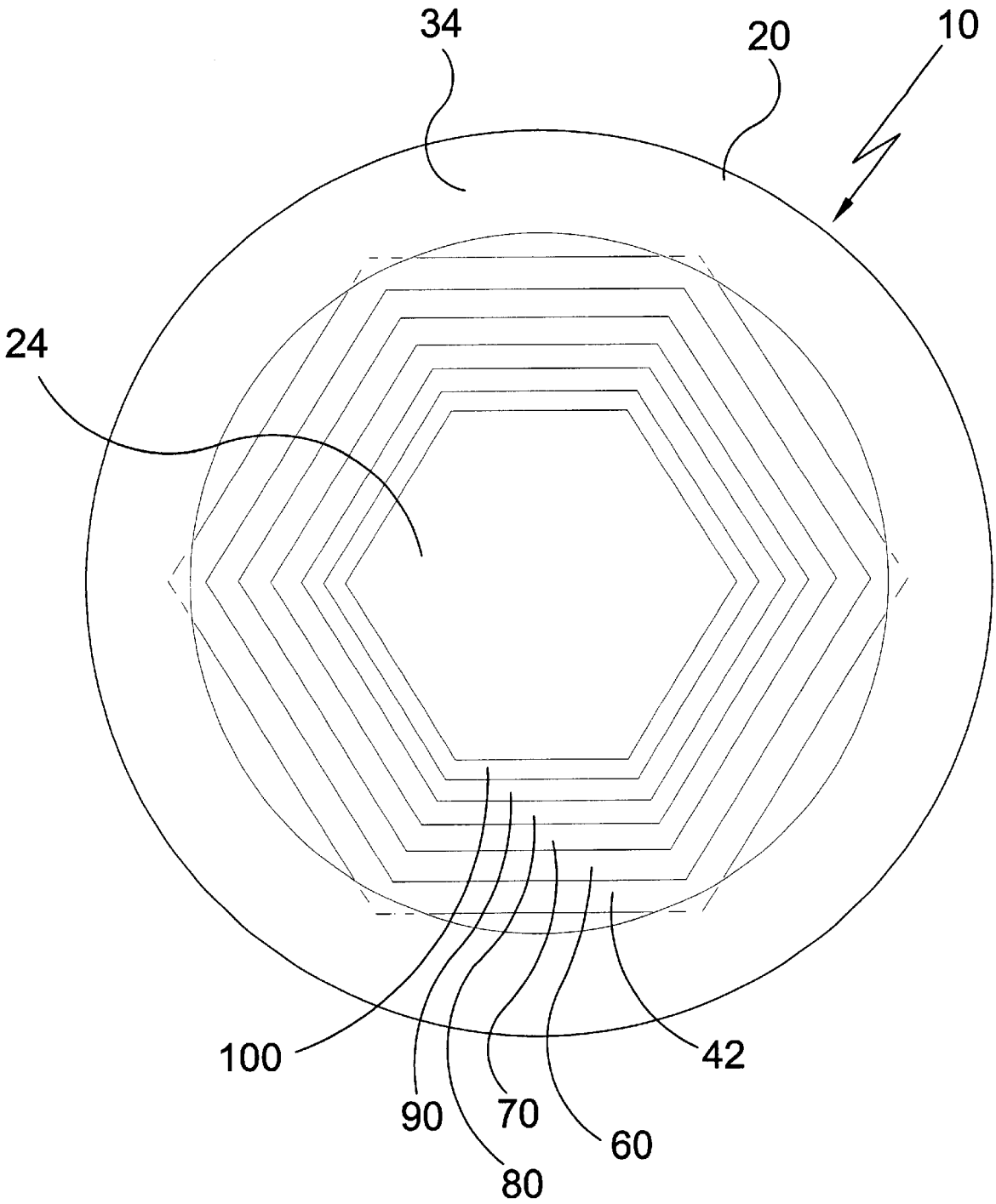
FIG. 5 is a top view of the present invention. A threaded retainer member retains the sleeves within the socket body cavity.
Figure 6:
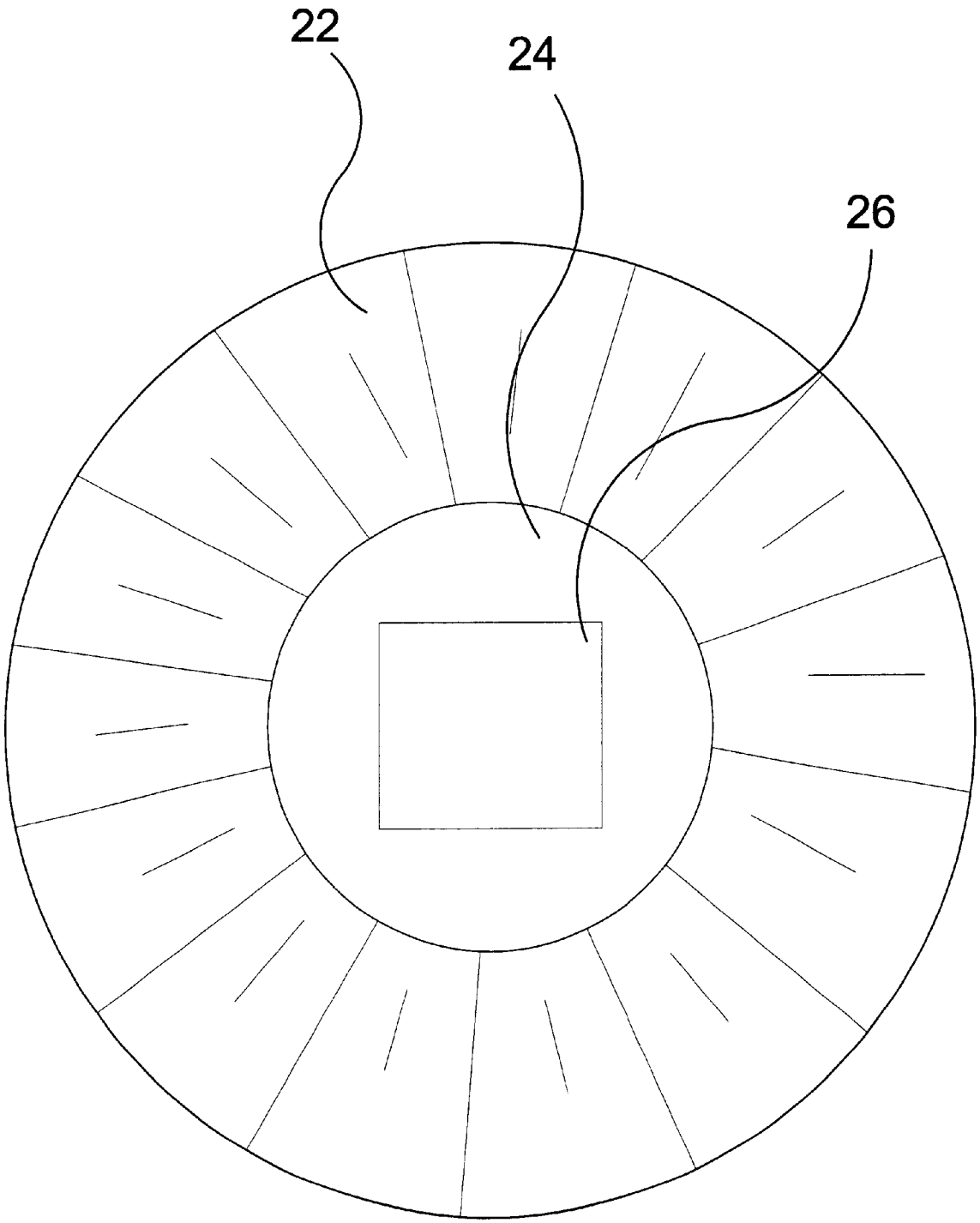
FIG. 6 is a bottom view of the present invention. The lower socket body of the present invention has a bore to accept the driving projection of a typical tool such as a ratchet.

A hexagon shaped peripheral sleeve 42 is inserted into the main body cavity 20, and has an exterior surface 44 that is flush against the main body cavity 36 along the length of the peripheral sleeve 42. The lower end 46 of the peripheral sleeve 42 rests on the plate 40. As shown in FIGS. 3–5, the upper end 48 of the peripheral sleeve 42 is held flush with the main body upper end 32, in that the retainer member 34 inside diameter causes the retainer member 34 to overlie the points of the peripheral sleeve 42 hexagon, thus preventing the spring 38 from de-compressing further and elevating the peripheral sleeve upper end 48 above the main body upper end 34. The peripheral sleeve 42 also has a reduced thickness at the lower end 46 that forms a downwardly facing shoulder 50 on the interior surface 52 of the peripheral sleeve 42.

Several additional hexagon shaped sleeves 60, are concentrically nested within the peripheral sleeve 42. Each sleeve 60,70,80,90,100 has a lower end 62,72,82,92,102 that is adjacent the plate 40 in the first position, as shown in FIGS. 3–4, an upper end 64,74,84,94,104, and an offset that forms an interior downwardly facing shoulder 66,76,86,96, 106 and an exterior upwardly facing shoulder 68,78,88,98, 108, as shown particularly in FIG. 8. As shown in FIG. 3, this arrangement prevents the sleeves 60,70,80,90,100 from sliding upwardly relative to the others when in the first position, while allowing downward sliding to a second position when a nut 16 bears upon one or more of them with sufficient force to compress the spring 38 and lower the plate 40.

FIG. 7 depicts the downward displacement of the innermost and smallest sleeve 100 by a hexagonal nut 16. The sleeve 100 slides downwardly with respect to the next largest sleeve 90 to the second position. The lower end 102 pushes on the plate 40 and compresses the spring 38, such that the plate 40 no longer bears upon the remaining sleeve lower ends 62,72,82,92.

To support such remaining sleeves 60,70,80,90, pairs of magnetic strips 110,112,114,116,118,120 are integrated with the sliding sleeves 60,70,80,90, the peripheral sleeve 42, and the upper body interior wall 122, to create magnetic couples between the sleeves 60,70,80,90, between the outermost sliding sleeve 60 and the peripheral sleeve 42, and between the peripheral sleeve 42 and the upper body interior wall 122, as shown in FIG. 4.

These magnetic attractions are of such a strength that the direct shear force on the magnetic strip pair 110 causes it to separate and allow the innermost sleeve 100 to be displaced downwardly by the nut 16. The other magnetically coupled pairs 112,114,116,118,120 are not separated, thus the remaining sleeves 60,70,80,90 are held in place although the plate 40 has been lowered. Since the innermost sleeve 100 will not need to remain in the first position while the plate 40 is lowered, the magnetic strip pair 110 between the innermost sleeve 100 and the next largest sleeve 90 can be eliminated in another embodiment.

In another circumstance, where the nut 16 corresponds to the size of the third sleeve 80, the intruding nut 16 bears upon the third sleeve 80 which, in turn, bears upon the two next smallest sleeves 90,100 through the interaction of the adjacent shoulders, e.g. the interior downwardly facing shoulder 86 of the third sleeve 80 bearing on the exterior upwardly facing shoulder 98 of the next smallest sleeve 90, and the interior downwardly facing shoulder 96 of the next smallest sleeve 90 bearing on the exterior upwardly facing shoulder 108 of the innermost sleeve 100. In this circumstance, magnetic strip pair 114 is sheared, while pairs 116,118,120 remain magnetically coupled.

In the preferred embodiment, the strength of the magnetic attraction between the magnetic strip pairs 110,112,114,116, 118,120 decreases from the outermost pair 120 to the innermost pair 110, in order to encourage the intended magnetic strip pair to shear. This decrease can be obtained by continuously decreasing the length of the magnetic strip pairs, decreasing the exposed exterior areas of the strips, decreasing the overall volume of the magnetic strip pairs, and/or utilizing materials of varying magnetic capabilities.

FIG. 9 depicts an additional embodiment of the socket 200 in which the peripheral sleeve's lower end 202 and the sliding sleeves' offset lower ends 204,206,208,210,212 are gradually angled instead of offset, the angle being of sufficient magnitude to duplicate the upwards vertical restraint function of the shoulders described above.

In the embodiment of the socket 300 depicted in FIG. 10, the peripheral sleeve 302 is integrated with the retainer member. The sliding sleeves 304,306,308,310,312,314 have right angled lower ends 316,318,320,322,324,326. The peripheral sleeve 302 presents a lower end 328 in position to prevent upwards vertical movement of the first sleeve lower end 316. Starting with the first sleeve lower end 316, all other sleeves 306,308,310,312,314 are restrained in the upwards vertical direction due to the vertical stacking of the lower ends 316,318,320,322,324,326. The integration of the peripheral sleeve 302 with the retainer member eliminates the need for a magnetic strip pair 330 between the peripheral sleeve and the upper body interior wall 332. As discussed above, this embodiment 300 also eliminates the magnetic strip pair 330 between the innermost sleeve 314 and the next largest sleeve 312.

With respect to the above description then, it is to be realized that the optimum material and dimensional relationships for the parts of the adjustable socket 10,200,300 will include variations in size, materials, shape, and form, which will occur to those skilled in the art upon review of the present disclosure. For example the components can be constructed from various metals, including, steel, and can have multiple main body sizes so as to provide the appropriate cavity for sleeves to properly engage all typical English and metric fastener projection sizes. All equivalent relationships to those illustrated in the drawings and described in the specification are intended to be encompassed by the present invention.

What is claimed as new and desired to be protected by Letters Patent is set forth in the appended claims:

1. An adjustable socket for attachment to the driving projection of a tool and for receiving and turning variously sized fastener projections, comprising:

a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end;

a plate positioned in the main body cavity, the plate being generally perpendicular to the main body central axis;

a spring positioned within the main body cavity to bear upon the main body and the plate, such that the plate is biased toward the upper terminal end;

a peripheral sleeve concentrically mounted within the main body cavity, the peripheral sleeve having an inner surface defining a bore, an upper end and a lower end, the lower end having a downwardly facing shoulder about the bore, the bore being shaped for receiving and engaging one of the fastener projections;

a retainer member attached to the upper terminal end, the retainer member having a portion protruding across the main body cavity to an extent that the peripheral sleeve is prevented from exiting the main body cavity;

a first sliding sleeve, having a lower end, the first sliding sleeve being concentrically mounted within the peripheral sleeve in a first position, wherein the first sliding sleeve and peripheral sleeve lower ends are adjacent the plate, and wherein the first sliding sleeve is slidably displaceable in a downward direction relative to the peripheral sleeve, in a coaxially aligned relationship, to a second position, wherein the first sliding sleeve lower end displaces the plate from the peripheral sleeve lower end;

a plurality of sliding sleeves, in addition to the first sliding sleeve, each having a lower end, each sliding sleeve in the plurality being of descending width, such that the sleeves are concentrically mounted within the first sliding sleeve in a first position, wherein the lower ends of the peripheral sleeve and all the sliding sleeves are adjacent the plate, and wherein each of the plurality is slidably displaceable in a downward direction relative to the next largest sliding sleeve, the displacement being in a coaxially aligned relationship with such next largest sliding sleeve, to a second position, wherein the displaced sliding sleeve lower end displaces the plate from the peripheral sleeve lower end and the lower ends of all the sliding sleeves larger than the one so displaced;

each of the sliding sleeves having an inner surface defining a bore, the bore being shaped to engage one of the fastener projections, each of the sliding sleeves' lower ends also being offset to form an exterior upwardly facing shoulder and an interior downwardly facing shoulder, each exterior shoulder corresponding with the interior shoulder of the next largest of the sliding sleeves, the exterior shoulder of the first sliding sleeve corresponding with the downwardly facing shoulder of the peripheral sleeve, the shoulder correspondences preventing upward displacement of the sliding sleeves from the first position; and a plurality of magnetic strip pairs, each pair being magnetically coupled, the first of such pairs having a first strip integrated with the upper body interior surface and a second strip integrated with the peripheral sleeve, the second of such pairs having a first strip integrated with the peripheral sleeve and a second strip integrated with the first sliding sleeve, the remainder of the pairs in the plurality having a first strip integrated with one of the sliding sleeves, and a second strip integrated with the next smallest sliding sleeve, all of the pairs in the plurality being attached such that the first strip and second strip of each pair are adjacent to one another when the sliding sleeves are in the first position;

such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the magnetic strip pairs of the larger sliding sleeves retaining the larger sliding sleeves in the first position, and further such that, when the fastener projection is removed from the main body cavity, the spring urges the plate against the lower ends of the downwardly displaced sliding sleeves, forcing such sliding sleeves back to the first position.

2. The socket of claim 1, wherein the strips in the magnetic strip pairs each have a magnetic coupling force, the coupling forces decreasing from the outermost pair to the innermost pair.

3. The socket of claim 1, wherein the strips in the magnetic strip pairs each have a length, the lengths decreasing from the outermost pair to the innermost pair.

4. The socket of claim 1, wherein the strips in the magnetic strip pairs each have an exterior area, the exterior areas decreasing from the outermost pair to the innermost pair.

5. The socket of claim 1, wherein the strips in the magnetic strip pairs each have a volumes, the volumes decreasing from the outermost pair to the innermost pair.

6. The socket of claim 1, wherein the retainer member is threadably attached to the upper body.

7. The socket of claim 1, wherein the retainer member is rotatably attached to the upper body.

8. The socket of claim 1, wherein the sliding sleeves each have an upper end, the upper ends being substantially flush to the upper body terminal end when the sliding sleeves are in the first position.

9. The socket of claim 1, wherein the sliding sleeves' bores are hexagon shaped.

10. The socket of claim 1, wherein the sliding sleeves' bores are polygon shaped.

11. The socket of claim 1, wherein the sliding sleeves' bores are circumferentially notched for engaging the points of a polygon shaped fastener projection.

12. The socket of claim 1, wherein the sliding sleeves' bores are square.

13. The socket of claim 1, wherein the driving projection is square.

14. An adjustable socket for attachment to the driving projection of a tool and for receiving and turning variously sized fastener projections, comprising:

a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end;

a plate positioned in the main body cavity, the plate being generally perpendicular to the main body central axis;

a spring positioned within the main body cavity to bear upon the main body and the plate, such that the plate is biased toward the upper terminal end;

a peripheral sleeve concentrically mounted within the main body cavity, the peripheral sleeve having an inner surface defining a bore, an upper end and a lower end, the lower end having a downwardly facing shoulder about the bore, the bore being shaped for receiving and engaging one of the fastener projections;

means for retaining the peripheral sleeve within the main body cavity;

a first sliding sleeve, having a lower end, the first sliding sleeve being concentrically mounted within the peripheral sleeve in a first position, wherein the first sliding sleeve and peripheral sleeve lower ends are adjacent the plate, and wherein the first sliding sleeve is slidably displaceable in a downward direction relative to the peripheral sleeve, in a coaxially aligned relationship, to a second position, wherein the first sliding sleeve lower end displaces the plate from the peripheral sleeve lower end;

a plurality of sliding sleeves, in addition to the first sliding sleeve, each having a lower end, each sliding sleeve in the plurality being of descending width, such that the sleeves are concentrically mounted within the first sliding sleeve in a first position, wherein the lower ends of the peripheral sleeve and all the sliding sleeves are adjacent the plate, and wherein each of the plurality is slidably displaceable in a downward direction relative to the next largest sliding sleeve, the displacement being in a coaxially aligned relationship with such next largest sliding sleeve, to a second position, wherein the displaced sliding sleeve lower end displaces the plate from the peripheral sleeve lower end and the lower ends of all the sliding sleeves larger than the one so displaced;

each of the sliding sleeves having an inner surface defining a bore, the bore being shaped to engage one of the fastener projections;

means for retaining the sliding sleeves larger than the displaced sleeves within the main body cavity; and means for magnetically retaining each of the sliding sleeves larger in the first position when the plate is moved away from each of said larger sliding sleeve's lower ends;

such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the means for magnetically retaining retains at least one sliding sleeve in the first position and retaining the larger sliding sleeves in the first position, and further such that, when the fastener projection is removed from the main body cavity, the spring urges the plate against the lower ends of the downwardly displaced sliding sleeves, forcing such sliding sleeves back to the first position.

15. The socket of claim 14, wherein the sliding sleeves each have an upper end, the upper ends being substantially flush to the upper body terminal end when the sliding sleeves are in the first position.

16. The socket of claim 14, wherein the sliding sleeves' bores are hexagon shaped.

17. The socket of claim 14, wherein the sliding sleeves' bores are polygon shaped.

18. The socket of claim 14, wherein the sliding sleeves' bores are circumferentially notched for engaging the points of a polygon shaped fastener projection.

19. The socket of claim 14, wherein the sliding sleeves' bores are square.

20. The socket of claim 14, wherein the driving projection is square.

21. An adjustable socket for attachment to the driving projection of a tool and for receiving and turning variously sized fastener projections, comprising:

a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end;

a plate positioned in the main body cavity, the plate being generally perpendicular to the main body central axis;

a spring positioned within the main body cavity to bear upon the main body and the plate, such that the plate is biased toward the upper terminal end;

a peripheral sleeve concentrically mounted within the main body cavity, the peripheral sleeve having an inner surface defining a bore, an upper end and a lower end, the bore being shaped for receiving and engaging one of the fastener projections;

a retainer member attached to the upper terminal end, the retainer member having a portion protruding across the main body cavity to an extent that the peripheral sleeve is prevented from exiting the main body cavity;

a first sliding sleeve, having a lower end, the first sliding sleeve being concentrically mounted within the peripheral sleeve in a first position, wherein the first sliding sleeve and peripheral sleeve lower ends are adjacent the plate, and wherein the first sliding sleeve is slidably displaceable in a downward direction relative to the peripheral sleeve, in a coaxially aligned relationship, to a second position, wherein the first sliding sleeve lower end displaces the plate from the peripheral sleeve lower end;

a plurality of sliding sleeves, in addition to the first sliding sleeve, each having a lower end, each sliding sleeve in the plurality being of descending width, such that the sleeves are concentrically mounted within the first sliding sleeve in a first position, wherein the lower ends of the peripheral sleeve and all the sliding sleeves are adjacent the plate, and wherein each of the plurality is slidably displaceable in a downward direction relative to the next largest sliding sleeve, the displacement being in a coaxially aligned relationship with such next largest sliding sleeve, to a second position, wherein the displaced sliding sleeve lower end displaces the plate from the peripheral sleeve lower end and the lower ends of all the sliding sleeves larger than the one so displaced;

each of the sliding sleeves having an inner surface defining a bore, the bore being shaped to engage one of the fastener projections, each of the sliding sleeves' lower ends also being radially and outwardly disposed with respect to the central axis, the peripheral sleeve lower end having a reduced thickness to accommodate the first sliding sleeve lower end, the lower end outward dispositions causing the peripheral sleeve to prevent upward displacement of the first sliding sleeve from the first position, and causing the sliding sleeves to prevent the upward displacement of the next smallest sliding sleeve from the first position; and a plurality of magnetic strip pairs, each pair being magnetically coupled, the first of such pairs having a first strip integrated with the upper body interior surface and a second strip integrated with the peripheral sleeve, the second of such pairs having a first strip integrated with the peripheral sleeve and a second strip integrated with the first sliding sleeve, the remainder of the pairs in the plurality having a first strip integrated with one of the sliding sleeves, and a second strip integrated with the next smallest sliding sleeve, all of the pairs in the plurality being attached such that the first strip and second strip of each pair are adjacent to one another when the sliding sleeves are in the first position;

such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the magnetic strip pairs of the larger sliding sleeves retaining the larger sliding sleeves in the first position, and further such that, when the fastener projection is removed from the main body cavity, the spring urges the plate against the lower ends of the downwardly displaced sliding sleeves, forcing such sliding sleeves back to the first position.

22. The socket of claim 21, wherein the strips in the magnetic strip pairs each have a magnetic coupling force, the coupling forces decreasing from the outermost pair to the innermost pair.

23. The socket of claim 21, wherein the strips in the magnetic strip pairs each have a length, the lengths decreasing from the outermost pair to the innermost pair.

24. The socket of claim 21, wherein the strips in the magnetic strip pairs each have an exterior area, the exterior areas decreasing from the outermost pair to the innermost pair.

25. The socket of claim 21, wherein the strips in the magnetic strip pairs each have a volumes, the volumes decreasing from the outermost pair to the innermost pair.

26. The socket of claim 21, wherein the retainer member is threadably attached to the upper body.

27. The socket of claim 21, wherein the retainer member is rotatably attached to the upper body.

28. The socket of claim 21, wherein the sliding sleeves each have an upper end, the upper ends being substantially flush to the upper body terminal end when the sliding sleeves are in the first position.

29. The socket of claim 21, wherein the sliding sleeves' bores are hexagon shaped.

30. The socket of claim 21 wherein the sliding sleeves' bores are polygon shaped.

31. The socket of claim 21, wherein the sliding sleeves' bores are circumferentially notched for engaging the points of a polygon shaped fastener projection.

32. The socket of claim 21, wherein the sliding sleeves' bores are square.

33. The socket of claim 21, wherein the driving projection is square.

34. An adjustable socket for attachment to the driving projection of a tool and for receiving and turning variously sized fastener projections, comprising:

a main body formed about a central axis, wherein the main body has an integral lower body coaxially aligned about the central axis, the lower body having a lower terminal end and a bore coaxially aligned with the central axis and directed into the lower body for slidably receiving a driving projection, the main body also having an integral upper body, the upper body having an upper terminal end, and an interior surface forming a main body cavity within the main body, projecting into the main body, and coaxially aligning about the central axis projecting into the main body from the upper terminal end;

a plate positioned in the main body cavity, the plate being generally perpendicular to the m a in body central axis;

a spring positioned within the main body cavity to bear upon the main body and the plate, such that the plate is biased toward the upper terminal end;

a peripheral sleeve concentrically mounted within the main body cavity and attached to the upper body, the peripheral sleeve having an inner surface defining a bore, and a lower end, the bore being shaped for receiving and engaging one of the fastener projections;

a first sliding sleeve concentrically mounted within the peripheral sleeve in a first position, the first sliding sleeve having an angled lower flange extending under the peripheral sleeve lower end such that the peripheral sleeve lower end is adjacent the first sliding sleeve lower flange, and wherein the first sliding sleeve is slidably displaceable in a downward direction relative to the peripheral sleeve, in a coaxially aligned relationship, to a second position;

a plurality of sliding sleeves, in addition to the first sliding sleeve, each such sliding sleeve being of descending width such that the plurality is concentrically mounted within the first sliding sleeve in a first position, with each of the sliding sleeves having an angled lower flange, extending under the lower flange of the next largest sliding sleeve, such that the lower flange of the innermost sliding sleeve is adjacent the plate, and, further, wherein each of the plurality is slidably displaceable in a downward direction relative to the next largest sliding sleeve, the displacement being in a coaxially aligned relationship with such next largest sliding sleeve, to a second position, such that the lower flange of the innermost sliding sleeve displaces the plate when any of the sliding sleeves are displaced to the second position;

each of the sliding sleeves having an inner surface defining a bore, the bore being shaped to engage one of the fastener projections; and a plurality of magnetic strip pairs, each pair being magnetically coupled, the first of such pairs having a first strip integrated with the peripheral sleeve and a second strip integrated with the first sliding sleeve, the remainder of the pairs in the plurality having a first strip integrated with one of the sliding sleeves, and a second strip integrated with the next smallest sliding sleeve, all of the pairs in the plurality being attached such that the first strip and second strip of each pair are adjacent to one another when the sliding sleeves are in the first position;

such that the insertion of the fastener projection into the main body cavity slidably displaces the sliding sleeves having a size corresponding to or smaller than the fastener projection, the displacement being in a downward direction to the second position, the spring being simultaneously compressed and the plate displaced, the magnetic strip pairs of the larger sliding sleeves retaining the larger sliding sleeves in the first position, and further such that, when the fastener projection is removed from the main body cavity, the spring urges the plate against the lower flange of the innermost sliding sleeve, forcing the displaced sliding sleeves back to the first position.

35. The socket of claim 34, wherein the strips in the magnetic strip pairs each have a magnetic coupling force, the coupling forces decreasing from the outermost pair to the innermost pair.

36. The socket of claim 34, wherein the strips in the magnetic strip pairs each have a length, the lengths decreasing from the outermost pair to the innermost pair.

37. The socket of claim 34, wherein the strips in the magnetic strip pairs each have an exterior area, the exterior areas decreasing from the outermost pair to the innermost pair.

38. The socket of claim 34, wherein the strips in the magnetic strip pairs each have a volumes, the volumes decreasing from the outermost pair to the innermost pair.

39. The socket of claim 34, wherein the retainer member is threadably attached to the upper body.

40. The socket of claim 34, wherein the retainer member is rotatably attached to the upper body.

41. The socket of claim 34, wherein the sliding sleeves each have an upper end, the upper ends being substantially flush to the upper body terminal end when the sliding sleeves are in the first position.

42. The socket of claim 34, wherein the sliding sleeves' bores are hexagon shaped.

43. The socket of claim 34, wherein the sliding sleeves' bores are polygon shaped.

44. The socket of claim 34, wherein the sliding sleeves' bores are circumferentially notched for engaging the points of a polygon shaped fastener projection.

45. The socket of claim 34, wherein the sliding sleeves' bores are square.

46. The socket of claim 34, wherein the driving projection is square.

* * * * *